US006883311B2

(12) United States Patent
Liu

(10) Patent No.: US 6,883,311 B2
(45) Date of Patent: Apr. 26, 2005

(54) COMPACT DUAL LEG NOX ABSORBER CATALYST DEVICE AND SYSTEM AND METHOD OF USING THE SAME

(75) Inventor: Yi Liu, Troy, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 10/612,173

(22) Filed: Jul. 2, 2003

(65) Prior Publication Data

US 2005/0000208 A1 Jan. 6, 2005

(51) Int. Cl.[7] ..... F01N 3/00

(52) U.S. Cl. ..... 60/295; 60/274; 60/286; 60/287; 60/288; 60/298; 60/303

(58) Field of Search ..... 60/274, 286, 287, 60/288, 295, 297, 298, 301, 303, 320

(56) References Cited

U.S. PATENT DOCUMENTS 5,661,971 A 9/1997 Waschatz et al.
5,974,791 A 11/1999 Hirota et al.
6,016,653 A 1/2000 Glassey et al.
6,182,444 B1 2/2001 Fulton et al.
6,192,676 B1 2/2001 Zürbig et al.
6,212,885 B1 * 4/2001 Hirota et al. ..... 60/288
6,237,330 B1 5/2001 Takahashi et al.
6,321,530 B1 * 11/2001 Hoshi et al. ..... 60/274
6,467,259 B1 10/2002 Surnilla et al.
6,516,612 B1 2/2003 Okada et al.
6,644,023 B1 * 11/2003 Hirota et al. ..... 60/297
6,655,133 B1 * 12/2003 Kimura et al. ..... 60/296
6,679,052 B1 * 1/2004 Nakatani et al. ..... 60/297
2002/0058004 A1 5/2002 Bartley et al.
2002/0073694 A1 6/2002 Minami
2003/0010021 A1 1/2003 Nishiyama

* cited by examiner

*Primary Examiner*—Binh Q. Tran
(74) *Attorney, Agent, or Firm*—Brooks Kushman P.C.

(57) ABSTRACT

An apparatus, a system, and a method for treating exhaust gases from an internal combustion engine. The system and method employing the use of a catalytic device coaxial-arranged dual leg apparatus comprising a housing having a first flow path and a second flow path having coaxially arranged portions, a device for selectively directing the exhaust gases between the first flow path and the second flow path, and a first NOx adsorbing catalyst contained in the first flow path.

38 Claims, 3 Drawing Sheets

COMPACT DUAL LEG NOX ABSORBER CATALYST DEVICE AND SYSTEM AND METHOD OF USING THE SAME

BACKGROUND OF THE INVENTION

1. Field of the Invention

The present invention relates to a system and a method for treating exhaust gases from an engine.

2. Background Art

NOx adsorber technology is often times used to reduce the amount of NOx emission (content) in engine exhaust gases. A key component in this technology is the NOx adsorber catalyst, which functions as both an adsorbent and a three-way catalyst. During normal engine operations, the three-way catalyst first oxidizes NOx molecules using the excess oxygen in the engine exhaust, and then stores the oxidized NOx molecules on the adsorbent sites on the catalyst.

To ensure proper operability, the stored NOx must be removed chemically before the adsorbent becomes fully saturated, otherwise the NOx in the exhaust stream will bypass the adsorbent and exit directly to the atmosphere. A substantially oxygen free exhaust stream with adequate CO (carbon monoxide) and HC (hydrocarbon) is often times used to chemically release the stored NOx from the adsorbent sites and convert them to $N_2$ at the three-way catalyst sites. This NOx releasing/converting process is defined as NOx adsorber catalyst regeneration.

To obtain the substantially oxygen free exhaust stream, additional fuel is usually injected into either the engine cylinders or the exhaust pipe, upstream of the catalyst, to consume the oxygen. This additional fuel use typically results in at least an additional 2–6% fuel consumption increase, or a so-called fuel economy penalty, and results in a considerable operation cost for utilizing such an after treatment system.

In order to minimize the fuel economy penalty, the amount of oxygen in the exhaust gases during regeneration should be kept as low as possible. To this end, parallel-arranged dual leg NOx catalyst systems minimize the fuel required by only using a portion of the exhaust gases for catalyst regeneration. These systems have been demonstrated in the laboratory but are typically difficult to install in vehicles because of their space requirements, i.e., they require more space than is typically available.

It would be desirable to provide a system and method for treating exhaust gases from an engine which overcomes at least one of the problems in the prior art.

SUMMARY OF THE INVENTION

In at least one aspect, the present invention generally provides an apparatus, a system and a method for treating exhaust gases from an engine. The present invention reduces the typical space required for a NOx adsorbing catalyst using a coaxial-arranged dual leg treatment apparatus. In at least one embodiment, the coaxial-arranged dual leg apparatus comprises a housing having a first flow path and a second flow path having coaxially arranged portions, a device for selectively directing the exhaust gases between the first flow path and the second flow path, and a first NOx adsorbing catalyst contained in the first flow path.

The above features, and other features and advantages of the present invention are readily apparent from the following detailed descriptions thereof when taken in connection with the accompanying drawings.

BRIEF DESCRIPTION OF THE DRAWINGS

The invention will now be described in greater detail in the following way of example only and with reference to the attached drawings, in which.

DETAILED DESCRIPTION OF THE PREFERRED EMBODIMENTS

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
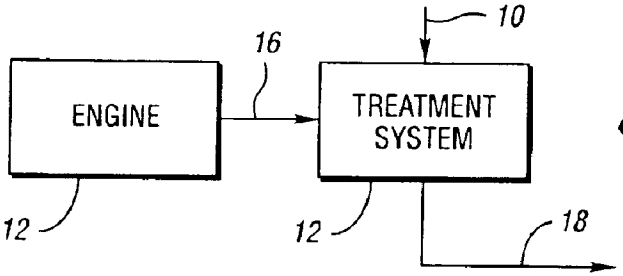
FIG. 1 is a schematic block diagram of the use of a catalyst system in accordance with the present invention.

With reference to the Figures, the present invention will now be described in greater detail. As shown schematically in FIG. 1, the present invention relates to a NOx adsorbing catalyst treatment system 10 for treating exhaust gases from an engine 12. The system 10 can be used for engines that use various types of fuel, including, but not necessarily limited to, diesel and other gasoline engines such as gas direct-injection engines (GDI). These types of engines include, but are not necessarily limited to, car, truck, boat, and other types of engines such as locomotive, generator set, and mining, and construction vehicles. At least some, if not all, of the components of the treatment system 10 are generally downstream from the engine 12. The engine 12 and the treatment system 10 are in communication via an exhaust conduit 16. The treatment system 10 treats the exhaust gases from the engine 12 and then exhausts the treated gases to the atmosphere via output conduit 18.

Figure 2:
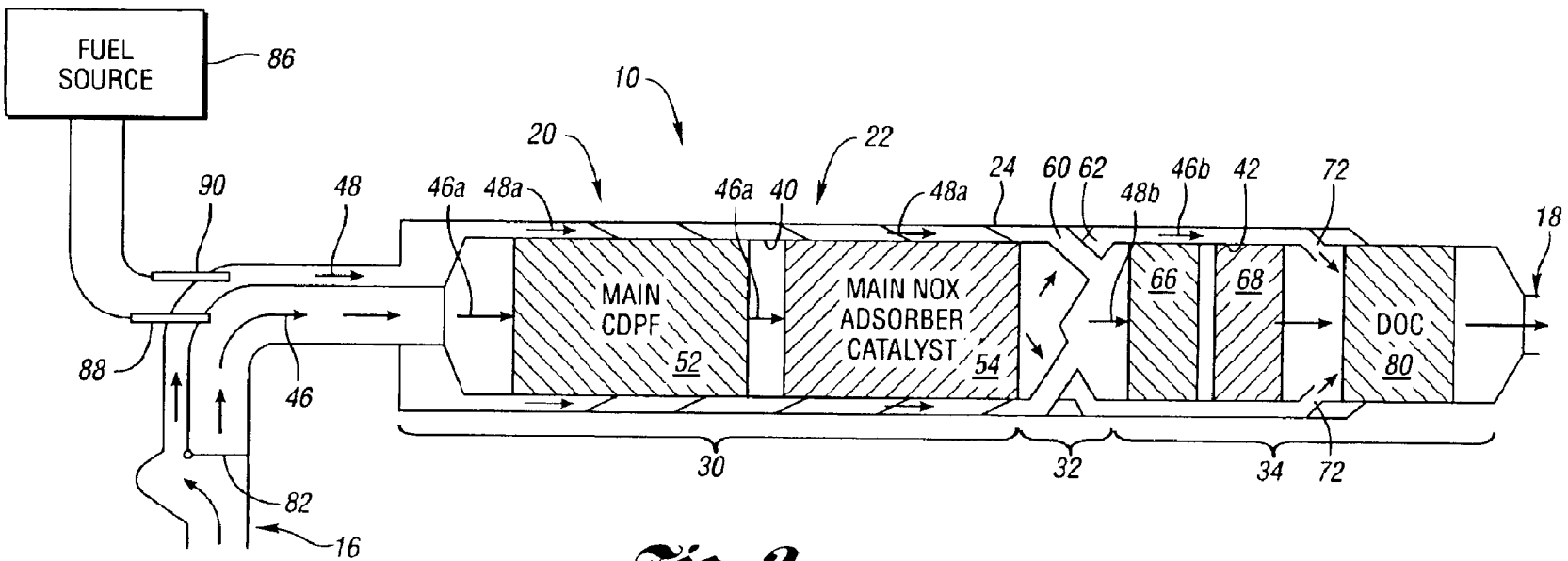
FIG. 2 is a cross sectional view of a component shown in FIG. 1.

FIG. 2 illustrates a first embodiment of the treatment system 10 in accordance with at least one aspect of the present invention. The treatment system 10 includes a catalytic device 20. The catalytic device 20 includes a housing 22. The housing 22 extends between and connects the conduits 16 and 18. The housing 22 includes an outer wall 24 which helps to define a first portion 30, an interchange portion 32, and a second portion 34. The first portion 30 generally extends between and connects the conduit 16 and the interchange portion 32. The interchange portion 32 generally extends between and connects the first portion 30 of the housing 22 and the second portion 34 of the housing. The second portion 34 of the housing 22 generally extends between and connects the interchange portion 32 of the housing 22 and the output conduit 18.

The housing 22 further includes a first interior wall 40 and a second interior wall 42, both of which are spaced axially inward of the outer wall 24 and help to define a main flow path 46 and a secondary flow path 48 of the housing 22. Generally, the main flow path 46 and the secondary flow path 48 run throughout the catalytic device 20 in a generally coaxial arrangement. As shown in an embodiment shown in FIG. 2, the main flow path 46 is axially inward the second flow path 48 in the first portion 30 of the housing 22 while the main flow path 46 is axially outward the secondary flow path in the second portion 34 of the housing. The change in the relative orientation of the main and secondary flow paths 46 and 48 generally occurs in the interchange portion 32 of the housing 22. It should be understood by those skilled in the art that either the main flow path 46 or the secondary flow path 48 could initially be spaced axially outward of the other flow path without departing from the spirit of the present invention. The catalytic device 20 and its operation will be explained in greater detail below.

The first interior wall 40 helps to define a first main flow path portion 46*a* in the first portion 30 of the housing 22. The walls 24 and 40 help to define a first secondary flow path portion 48*a* in the first portion 30 of the housing 22. In the first portion 30 of the housing 22, the first main flow path portion 46*a* is axially inward of the first secondary flow path 48*a*.

The first housing portion 30 contains a main catalyst diesel particulate filter 52 and a main NOx adsorbing catalyst 54. As shown in FIG. 2, the main catalyst diesel particulate filter 52 is upstream of the NOx adsorbing catalyst 54 and both are housed within a chamber formed by and within the first interior wall 40. In this arrangement, gases flowing through the first main flow path portion 46*a* pass through both the main catalyst diesel particulate filter 52 and the NOx adsorbing catalyst 54. Any suitable filter 52 and catalyst 54 known to those of ordinary skill in the art can be used. Suitable samples of filter 52 includes, but are not necessarily limited to, Cordierite, Silicon carbide, fiber ceramic and sintered metal filters. Suitable samples of catalyst include, but are not necessarily limited to, barium or strontium based catalyst, preferably coated onto honeycomb ceramic substrates.

In the interchange portion 32 of the housing 22, a first conduit 60 is provided that extends axially inward from the outer wall 24 and the first inner wall 40 towards the center axis of the housing 22 such that the second flow path 48 is directed axially inward. Also in the interchange portion 32 of the housing 22, the main flow path 46 communicates with a second conduit 62 that extends axially outward from the center axis of the housing 22 up to the outer wall 24 and the second interior wall 42. The conduits 60 and 62 redirect the flow paths 46 and 48 transversely (i.e., angled) away from their respective locations in the first portion 30 of the housing 22.

The second interior wall 42 is located in the second portion 34 of the housing 22 longitudinally spaced from the first inner wall 40. The second interior wall 42 helps to define a second secondary flow path portion 48*b* in the second portion 34 of the housing 22. The walls 24 and 42 help to define a second main flow path portion 46*b* in the second potion 34 of the housing 22. In the second portion 34 of the housing 22, the second main flow path portion 46*b* is axially outward the second secondary flow path portion 48*b*.

The second housing portion 34 contains a secondary catalyzed diesel particulate filter 66 and a secondary NOx adsorbing catalyst 68. As shown in FIG. 2, the secondary catalyzed diesel particulate filter 66 is upstream of the secondary NOx adsorbing catalyst 68 and both are housed within a chamber formed by and within the second interior wall 42. In this arrangement, gases passing through the second secondary flow path portion 48*b* pass through both the secondary catalyst diesel particulate filter 66 and the secondary NOx adsorbing catalyst 68. In this arrangement, the second main flow path portion 46*b* is axially outward the secondary catalyst diesel filter 66 and the secondary NOx adsorbing catalyst 68. The secondary catalyst diesel filter 66 can be the same type of filter as the main catalyst diesel filter 52 but may be smaller in size. The filters 52 and 66 can have any relative size, however, preferably, the secondary filter 66 is about one-tenth to about the same size of the main filter 52, and is more preferably about one-quarter to one-half the size of the main filter 52. Likewise, the secondary NOx adsorbing catalyst 68 can be the same type of catalyst as the main NOx adsorbing catalyst 54 but may be smaller in size. The catalysts 54 and 68 can have any relative size, however, preferably, the secondary catalyst 68 is about one-tenth to about the same size of the main catalyst 54, and is more preferably about one-quarter to one-half the size of the main catalyst 54.

The second portion 34 of the housing 22 also includes a third conduit 72 that extends axially inward from the outer wall 24 and the second wall 42 towards the center axis of the housing 22. The third conduit 72 directs gases flowing from the second main flow path portion 46*b* into chamber 76. The gases flowing from the second secondary flow path 48*b* also flow into chamber 76. The second portion 34 also includes a diesel oxidizing catalyst 80. The diesel oxidizing catalyst 80 is located between the chamber 76 and the output conduit 18 such that the gases from the second main and secondary flow path portions 46*b* and 48*b*, respectively, ultimately flow into and through diesel oxidizing catalyst 80. It should be understood that while the diesel oxidizing catalyst (DOC) 80 is shown to be within the housing 22, the DOC could be outside the housing as long as the gases from the flow paths 46 and 48 are able to pass through the DOC, if desired.

As shown in FIG. 2, the exhaust conduit 16 includes a valve 82 for directing, i.e., splitting, the majority of the exhaust gases from the engine 12 into the main flow path 46 or the secondary flow path 48. It should be understood by those skilled in the art that other devices can be used to selectively direct the exhaust gases without departing from the spirit of the present invention. Suitable examples include, but are not necessarily limited to, two-way valves. It should also be understood by those skilled in the art that the value 82 could be incorporated in the housing 22 rather than conduit 16.

Figure 3:
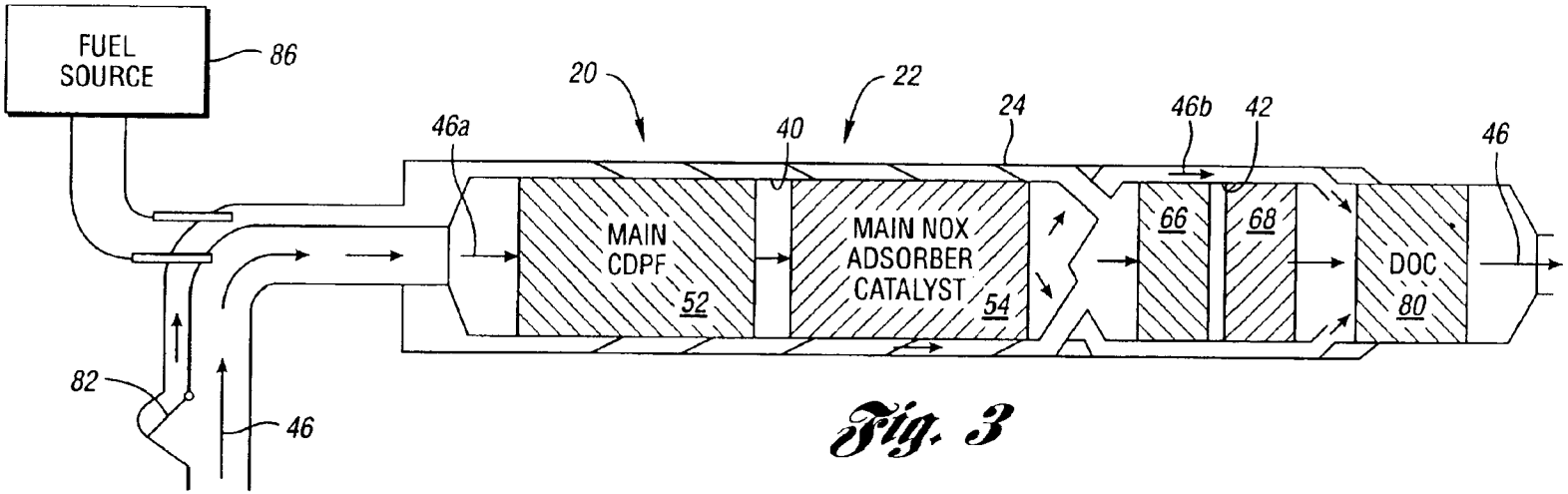
FIG. 3 is a view similar to FIG. 2 showing the operation of the component under a first condition.

Under normal operating conditions, the valve 82 will be in the closed position to the secondary flow path so that the majority of the exhaust gases (typically about 85–95%) from the engine 12 will flow from the engine into the main flow path 46, while the remainder (typically about 5–15%) will flow into the secondary flow path 48. It should be understood that the relative amounts of the flow into paths 46 and 48 can vary from the typical amounts stated herein. This configuration is shown schematically in FIG. 3. As the gases flow through the main flow path 46 into the housing 22, they first go through the main catalyzed diesel particulate filter 52 to remove large particulate material such as solid carbon, oil ash, and soluble organic fraction. After exiting the filter 52, the gases then flow through the main NOx adsorbing catalyst 54 where NO in the exhaust gases are catalyzed to $NO_2$. The $NO_2$ is then adsorbed by the sites on the catalyst 54. The gases then moves through the housing 22 into the interchange portion 32 through second conduit 62 and are diverted axially outward and around the secondary filter 66 and the secondary NOx adsorbing catalyst 68 which are located in the secondary flow path 48. The gases then flow back down through the third conduit 72 into chamber 76 and then through diesel oxidizing catalyst 80 where the exhaust gases are further purified, i.e., oxidized and catalyzed. The exhaust gases are then outputted to the environment in the normal course through the output conduit 18.

Figure 4:
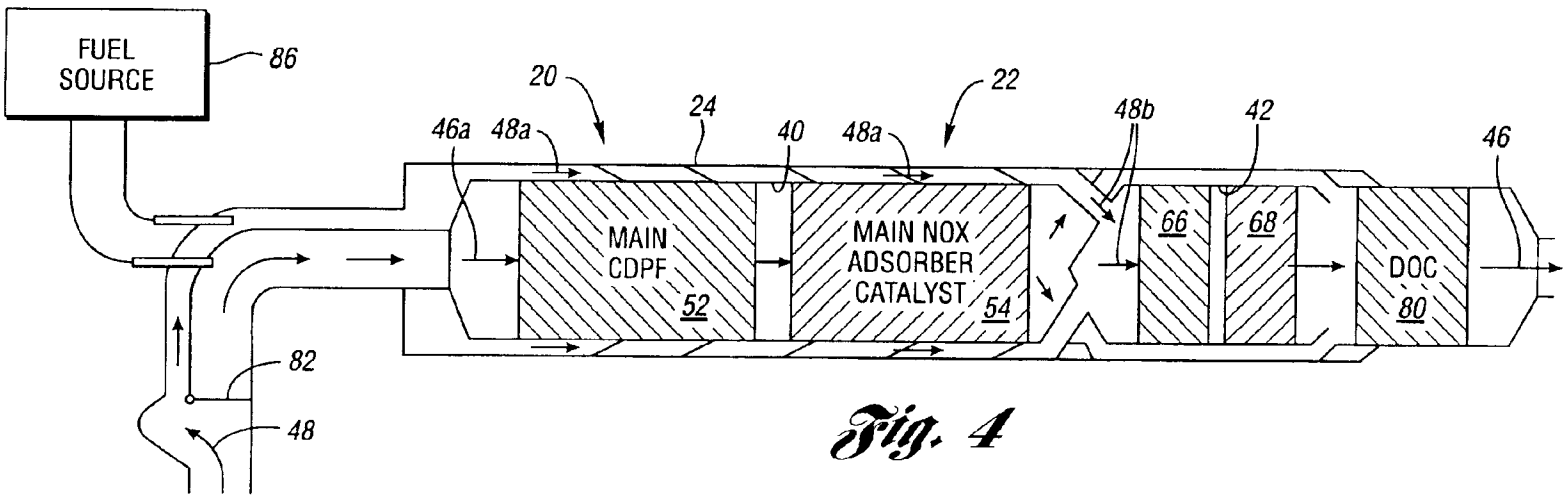
FIG. 4 is a view similar to FIG. 3 showing the operation of the component under a second condition.

Because of the type of catalyst that is employed in the NOx adsorbing catalyst 54, the catalyst requires periodic chemical regeneration. A source of fuel 86 is provided for regenerating the catalyst 54. A control system (not shown), including sensors in communication with control logic, determines timing of the periodic regeneration of the main and secondary NOx adsorbing catalysts 54 and 66, respectively. To chemically regenerate catalyst 54, fuel from fuel source 86 is injected through first fuel injector 88 into the main flow path 46. It should be understood by those skilled in the art that reductant agents other than fuel, such as CO and $H_2$, can also be an used to regenerate the NOx adsorbing catalysts without departing from the spirit of the present invention. It should be understood by those skilled in the art that devices other than fuel injectors can be used to selectively direct fuel or another reducing agent to flow into the NOx adsorbing catalysts without departing from the spirit of the present invention. To minimize the amount of fuel that is required during this fuel injection step, the valve 82 is essentially opened (FIG. 4) for the secondary flow path 48 and essentially closed for the main flow path 46 so that at least a substantial portion, (typically at least a majority, and more preferably about 85–95%), of the exhaust gases are diverted into the secondary flow path with the remainder flowing into the main flow path. The fuel from the fuel source 86 then proceeds through the catalyst 54 in an essentially, or at least substantially, undiluted manner for maximum catalytic generation.

When the valve 82 is essentially opened and the majority of the exhaust gases flow through the secondary flow path 48, the majority of exhaust gases are routed through the first portion 30 of the housing 22 through the first secondary flow path portion 48*b* at a location spaced axially from the main particulate filter 52 and the main NOx adsorbing catalyst 54. As the gases flow into the interchange portion 32 of the housing 22, the gases flow through the first conduit 60 axially inward through the second secondary flow path portion 48*b* into the secondary particulate filter 66 and then through the second NOx adsorbing catalyst 68, where the gases are subjected to the filtering and catalyzing in a similar fashion as in the main filter 52 and the main NOx adsorbing catalyst 54. The exhaust gases then proceed through chamber 76 and diesel oxidizing catalyst 80 where further oxidizing and catalyzation occurs, and then out through the output conduit 18. While this can vary depending upon the relative size of the flow paths and other components (such as catalysts), this type of operation, i.e., flowing the majority of exhaust gas through the secondary flow path 48, occurs typically about 15% of the time so the catalyst 54 can be periodically regenerated without appreciably effecting the catalytic operation of the catalytic device 20. The remainder of the time, i.e., under normal operating conditions, the majority of the exhaust gases flows through the main flow path 46. During normal operating conditions, as necessary, the control system regenerates the secondary NOx adsorbing catalyst 68 in a similar fashion by injecting fuel from fuel source 86 into the secondary flow path 48 using the second injector 90. Those skilled in the art will recognize that required regeneration periods will be specific to individual systems and operating conditions and that the above percentages are illustrations rather than limitations of the present invention.

Figure 5:
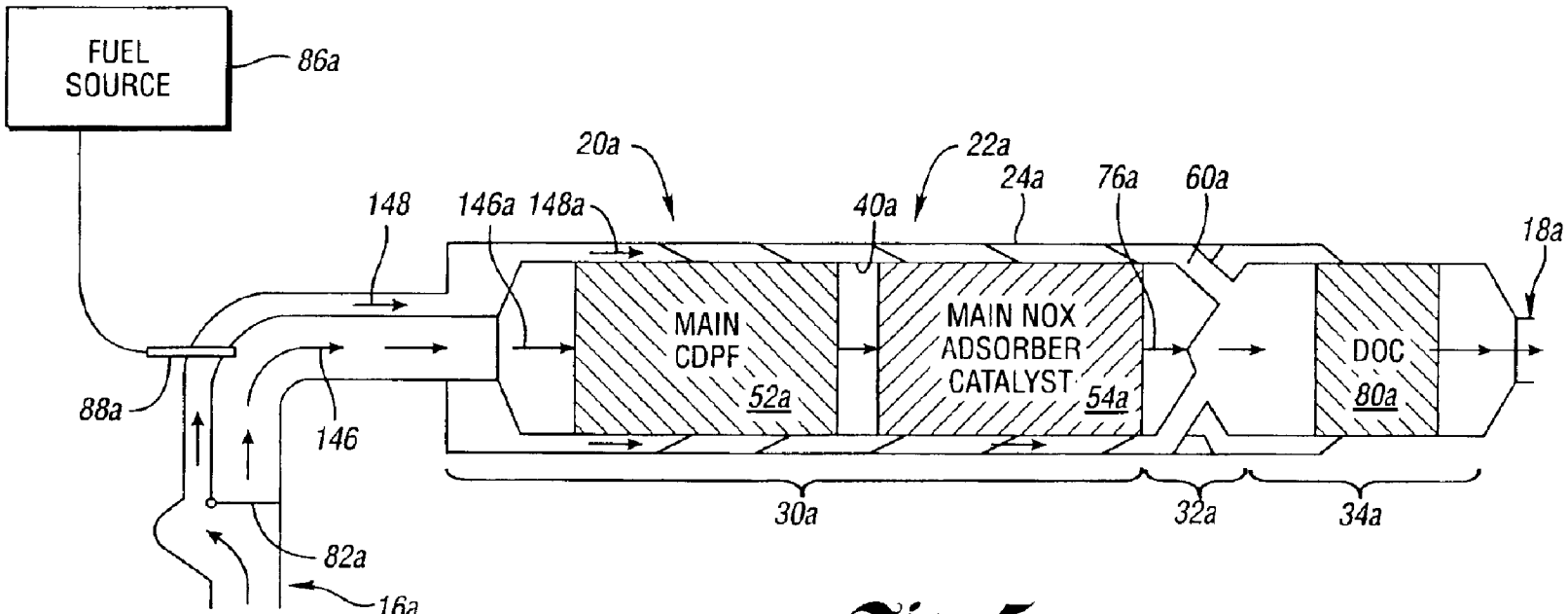
FIG. 5 is a view similar to FIG. 2 illustrating another embodiment in accordance with the present invention.

FIG. 5 shows a catalytic device 20*a* made in accordance with a second embodiment of the present invention. The second embodiment is similar to the first embodiment of the present invention illustrated in FIGS. 2–4. Accordingly, parts that are the same or similar are generally given the same reference numeral with the suffix "a" attached.

The catalytic device 20*a* differs from the catalytic device 20 of the first embodiment in that it does not have a secondary catalyzed diesel particulate filter or a secondary NOx adsorber and only has one fuel injector. This type of configuration while still having excellent NOx conversion has a lower NOx conversion than the device 20 of the first embodiment since the bypass exhaust (through the secondary flow path) will go untreated. The catalytic device 20*a* will be explained below in greater detail. The catalytic device 20*a* includes a housing 22*a*. The housing 22*a* extends between and connects the conduits 16*a* and 18*a*. The housing 22*a* includes an outer wall 24*a* which helps to define a first portion 30*a*, an interchange portion 32*a*, and a second portion 34*a*. The first portion 30*a* generally extends between and connects the conduit 16*a* and the interchange portion 32*a*. The interchange portion 32*a* generally extends between and connects the first portion 30*a* of the housing 22*a* and the second portion 34*a* of the housing. The second portion 34*a* of the housing 22*a* generally extends between and connects the interchange portion 32*a* of the housing 22*a* and the output conduit 18*a*.

The housing 22*a* further includes a first interior wall 40*a* spaced axially inward of the outer wall 24*a* which helps to define a main flow path 146 and a secondary flow path 148 of the housing 22*a*. Generally, the main flow path 146 and the secondary flow path 148 run throughout the catalytic device 20*a* in a generally coaxial arrangement. As shown in an embodiment shown in FIG. 5, the main flow path 146 is axially inward the second flow path 148 in the first portion 30*a* of the housing 22*a*. It should be understood by those skilled in the art that the secondary flow path 148 could initially be spaced axially inward of the main flow path 146 without departing from the spirit of the present invention. The catalytic device 20*a* and its operation will be explained in greater detail below.

The first interior wall 40*a* helps to define a first main flow path portion 146*a* in the first portion 30*a* of the housing 22*a*. The walls 24*a* and 40*a* help to define a first secondary flow path portion 148*a* in the first portion 30*a* of the housing 22*a*. In the first portion 30*a* of the housing 22*a*, the first main flow path portion 146*a* is axially inward of the first secondary flow path 148*a*.

The first housing portion 30*a* contains a catalyst diesel particulate filter 52*a* and a NOx adsorbing catalyst 54*a*. As shown in FIG. 5, the catalyst diesel particulate filter 52*a* is upstream of the NOx adsorbing catalyst 54*a* and both are housed within a chamber formed by and within the interior wall 40*a*. In this arrangement, gases flowing through the first main flow path portion 146*a* pass through both the main catalyst diesel particulate filter 52*a* and the NOx adsorbing catalyst 54*a*.

In the interchange portion 32*a* of the housing 22*a*, a first conduit 60*a* is provided that extends axially inward from the outer wall 24*a* and the first inner wall 40*a* towards the center axis of the housing 22*a* such that the second flow path 148 is directed axially inward. The conduit 60*a* redirects the flow path 148 transversely (i.e., angled) toward the center of the housing 22*a*, so that the gases flowing from the first secondary flow path portion 148*a* are directed into chamber 76*a*.

The gases flowing from the first main flow path portion 146*a* also flow into chamber 76*a*. The second portion 34*a* also includes a diesel oxidizing catalyst 80*a*. The diesel oxidizing catalyst 80*a* is located between the chamber 76*a* and the output conduit 18*a* such that the gases from the main and secondary flow paths 146 and 148, respectively, ultimately flow into and through diesel oxidizing catalyst 80*a*.

As shown in FIG. 5, the exhaust conduit 16*a* includes a valve 82*a* for directing the exhaust gases from the engine 12 into either the main flow path 146 or the secondary flow path 148. It will be clear to those skilled in the art that other devices can be used to selectively direct the exhaust gases without departing from the spirit of the present invention.

Under normal operating conditions, the valve 82*a* will be in the essentially closed position so that the majority of the exhaust gases from the engine 12 will flow from the engine into the main flow path 146. As the gases flow through the main flow path 146, they first go through the catalyzed diesel particulate filter 52*a* to remove large particulate material. After exiting the filter 52*a*, the gases then flow through the NOx adsorbing catalyst 54*a* where the exhaust gases are catalyzed to remove the NOx from the exhaust gases. The gases then moves through the housing 22*a* passing axially inward of the interchange portion 32*a* into chamber 76*a* and then through diesel oxidizing catalyst 80*a* where the exhaust fumes are further purified. The exhaust gases are then outputted to the environment in the normal course through the output conduit 18*a*.

A source of fuel 86*a* is provided for regenerating the catalyst 54*a*. A control system (not shown), including sensors in communication with control logic, determines timing of the periodic regeneration of the NOx adsorbing catalyst 54*a*. To chemically regenerate catalyst 54*a*, fuel from fuel source 86*a* is injected through fuel injector 88*a* into the main flow path 146. To minimize the amount of fuel that is required during this fuel injection, the valve 82*a* is essentially opened for the secondary flow path 148 and essentially closed for the main flow path 146 so that the majority of the exhaust gases are diverted into the secondary flow path instead of the main flow path. The fuel from the fuel source 186 then proceeds through the catalyst 54*a* in an essentially, or at least substantially, undiluted manner for maximum catalytic generation.

When the valve 82*a* is essentially opened and the majority of the exhaust gases flow through the secondary flow path 148, the exhaust gases are routed through the first portion 30*a* of the housing 22*a* through the first secondary flow path portion 148*b* at a location spaced axially outward from the particulate filter 52*a* and the NOx adsorbing catalyst 54*a*. As the gases flow into the interchange portion 32*a* of the housing 22*a*, the gases flow through the conduit 60*a* axially inward into and through the chamber 76 and through the diesel oxidizing catalyst 80*a* where oxidizing and catalyzation occurs, and then out through the output conduit 18.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for treating exhaust gases from an internal combustion engine, the system comprising:

a housing having a first flow path and a second flow path for transporting the exhaust gases from the engine, the housing containing a chamber downstream of the first and second flow paths, the flow paths having coaxially arranged portions, the first and second flow paths flowing into the chamber;

a gas directing device for selectively directing the exhaust gases between the first flow path and the second flow path;

a first NOx adsorbing catalyst contained in the first flow path, the first NOx adsorbing catalyst requiring periodic regeneration to purge accumulated NOx; and a first reductant supply source capable of selectively directing a gas containing a reducing agent to flow into the first NOx adsorbing catalyst.

2. The system of claim 1 wherein the second flow path has a portion that bypasses and is coaxial with the first NOx adsorbing catalyst.

3. The system of claim 2 wherein the portion of the secondary flow path that is coaxial with the first NOx adsorbing catalyst is spaced axially outward from the main flow path.

4. The system of claim 2 further comprising:

a diesel oxidation catalyst for oxidizing gases from the first and second flow paths, the diesel oxidation catalyst being downstream from the first NOx adsorbing catalyst.

5. The system of claim 4 wherein the chamber is upstream of the diesel oxidation catalyst and downstream of the first NOx adsorbing catalyst wherein the first and second flow paths are capable of flowing directly into the chamber, the chamber being in fluid communication with the diesel oxidation catalyst.

6. The system of claim 1 further comprising:

a first catalyzed diesel particulate filter contained in the first flow path upstream of the first NOx adsorbing catalyst.

7. The system of claim 1 further comprising:

a control system including sensors in communication with control logic, the control system operative to determine timing of the periodic regeneration of the first NOx adsorbing catalyst.

8. The system of claim 7 wherein the control system is further operative to regenerate the first NOx adsorbing catalyst by controlling the gas directing device to selectively direct at least a substantial portion of the exhaust gases from the engine through the second flow path while controlling the first reductant supply source to selectively direct the gas containing the reducing agent to flow towards the first NOx adsorbing catalyst.

9. The system of claim 8 wherein the reducing agent comprises hydrocarbons used as fuel for the internal combustion engine.

10. The system of claim 1 further comprising:

a second NOx adsorbing catalyst contained in the second flow path, the second NOx adsorbing catalyst requiring periodic regeneration to purge accumulated NOx.

11. The system of claim 10 further comprising:

a first catalyzed diesel particulate filter contained in the first flow path upstream of the first NOx adsorbing catalyst wherein the second flow path has a portion that bypasses and is coaxial with the first catalyzed diesel particulate filter and the first NOx adsorbing catalyst; and a second catalyzed diesel particulate filter contained in the second flow path upstream of the second NOx adsorbing catalyst wherein the first flow path has a portion that bypasses and is coaxial with the second catalyzed diesel particulate filter and the second NOx adsorbing catalyst.

12. The system of claim 11 wherein the coaxial portions of the first and second flow paths have inner and outer flow path portions wherein the inner flow path portion of the first flow path is capable of directing gases through the first NOx adsorbing catalyst and the outer flow path portion of the first flow path is capable of directing gases to bypass around the first NOx adsorbing catalyst.

13. The system of claim 12 wherein the housing has an interchange portion between coaxially arranged portions of the first and second flow paths wherein the first and second flow paths change relative position.

14. The system of claim 13 further comprising:

a control system including sensors in communication with control logic, the control system operative to determine timing of the periodic regeneration of the first and second NOx adsorbing catalysts.

15. The system of claim 14 wherein the control system is further operative:

to regenerate the first NOx adsorbing catalyst by controlling the gas directing device to selectively direct at least a substantial portion of the exhaust gases through the second flow path while controlling the first reductant supply source to selectively direct the gas containing the reducing agent to flow towards the first NOx adsorbing catalyst; and to regenerate the second NOx adsorbing catalyst by controlling the gas directing device to selectively direct at least a substantial portion of the exhaust gases to the first flow path while controlling the second reductant supply source to selectively direct the gas containing the reducing agent to flow towards the second NOx adsorbing catalyst.

16. The system of claim 15 wherein the first and second flow paths merge upstream of the diesel oxidation catalyst and are capable of directing flow through the diesel oxidation catalyst.

17. The system of claim 1, further comprising:

a second NOx adsorbing catalyst contained in the second flow path, the second NOx adsorbing catalyst requiring periodic regeneration to purge accumulated NOx, wherein the second NOx catalyst is downstream from and in the same general plane as the first NOx adsorbing catalyst.

18. The system of claim 17 further comprising:

a first catalyzed diesel particulate filter contained in the first flow path upstream of the first NOx adsorbing catalyst wherein the second flow path has a portion that bypasses and is coaxial with the first catalyzed diesel particulate filter and the first NOx adsorbing catalyst; and a second catalyzed diesel particulate filter contained in the second flow path upstream of the second NOx adsorbing catalyst wherein the first flow path has a portion that bypasses and is coaxial with, and axially outward relative to, the second catalyzed diesel particulate filter and the second NOx adsorbing catalyst.

19. A method for treating exhaust gases from an internal combustion engine, the method comprising:

transporting the exhaust gases from the engine to a housing that contains a first flow path, a second flow path, and a chamber downstream of the first and second flow paths, the flow paths having coaxially arranged portions, the first and second flow paths flowing into the chamber;

selectively directing the exhaust gases between the first flow path and the second flow path;

providing a first NOx adsorbing catalyst contained in the first flow path, the first NOx adsorbing catalyst requiring periodic regeneration to purge accumulated NOx; and selectively directing a gas containing a reducing agent to flow into the first NOx adsorbing catalyst to periodically regenerate the catalyst.

20. The method of claim 19 further comprising:

regenerating the first NOx adsorbing catalyst by selectively directing at least a substantial portion of the exhaust gases from the engine towards the second flow path while selectively directing the gas containing the reducing agent to flow through the primary NOx adsorbing catalyst.

21. A method for treating exhaust gases from an internal combustion engine, the method comprising:

providing a housing that has a first and second flow conduit in a coaxial arrangement, the housing containing a chamber downstream of the first and second flow conduit, the first flow conduit being axially inward of the second flow conduit, the first and second flow conduit flowing into the chamber;

providing a first NOx adsorbing catalyst in the first flow conduit, the first NOx adsorbing catalyst requiring periodic regeneration to purge accumulated NOx;

selectively directing the exhaust gases through the first and second flow conduits; and when directing gases through the second flow conduit, selectively directing a gas containing a reducing agent to flow through the first NOx adsorbing catalyst.

22. An apparatus for treating exhaust gases from an internal combustion engine, the apparatus comprising:

a housing having a first flow path and a second flow path for transporting the exhaust gases from the engine, the housing containing a chamber downstream of the first and second flow paths, the flow paths having coaxially arranged portions, the first and second flow paths flowing into the chamber;

a gas directing device for selectively directing the exhaust gases between the first flow path and the second flow path; and a first NOx adsorbing catalyst contained in the first flow path, the first NOx adsorbing catalyst requiring periodic regeneration to purge accumulated NOx.

23. The apparatus of claim 22 further comprising:

a first catalyzed diesel particulate filter contained in the first flow path upstream of the first NOx adsorbing catalyst.

24. The apparatus of claim 23 wherein the second flow path has a portion that bypasses and is coaxial with the first catalyzed diesel particulate filter and the first NOx adsorbing catalyst.

25. The apparatus of claim 24 wherein the portion of the second flow path that is coaxial with the first catalyzed diesel particulate filter and the first NOx adsorbing catalyst is spaced axially outward from the first flow path.

26. The apparatus of claim 23 further comprising:

a diesel oxidation catalyst in the housing for oxidizing gases from the first and second flow paths.

27. The apparatus of claim 26 wherein the diesel oxidation catalyst is downstream from the first NOx adsorbing catalyst.

28. The apparatus of claim 26 wherein the chamber is upstream of the diesel oxidation catalyst and downstream of the first NOx adsorbing catalyst wherein the first and second flow paths are capable of flowing directly into the chamber, the chamber being in fluid communication with the first and second flow paths and the diesel oxidation catalyst.

29. The apparatus of claim 22 further comprising:

a second NOx adsorbing catalyst contained in the second flow path, the second NOx adsorbing catalyst requiring periodic regeneration to purge accumulated NOx, wherein the second NOx catalyst is downstream from and in the same general plane as the first NOx adsorbing catalyst.

30. The apparatus of claim 29 further comprising:

a first catalyzed diesel particulate filter contained in the first flow path upstream of the first NOx adsorbing catalyst wherein the second flow path has a portion that bypasses and is coaxial with the first catalyzed diesel particulate filter and the first NOx adsorbing catalyst; and a second catalyzed diesel particulate filter contained in the second flow path upstream of the second NOx adsorbing catalyst wherein the first flow path has a portion that bypasses and is coaxial with, and axially outward relative to, the second catalyzed diesel particulate filter and the second NOx adsorbing catalyst.

31. The apparatus of claim 30 wherein the housing has a first portion, a second portion, and an interchange portion, extending between and connecting the first and second portions, the first flow path having a primary first flow path portion and a secondary first flow path portion, the second flow path having a primary second flow path portion and a secondary second flow path portion, the primary first flow path portion and the primary second flow path portion being located within the first housing portion, with the primary first flow path portion being spaced axially inward of the primary second flow path portion, and the secondary first flow path portion and the secondary second flow path portion being located within the second housing portion, with the secondary first flow path portion being spaced axially outward of the secondary second flow path portion.

32. The apparatus of claim 31 wherein the housing comprises an outer wall and a first inner wall and a second inner wall, the inner walls being spaced longitudinally from each other and axially inward from the outer wall, the primary first flow path portion being defined by the first inner wall and the primary second flow path portion being defined by the outer wall and the first inner wall.

33. The apparatus of claim 31 wherein the secondary second flow path portion is defined by the second inner wall and the secondary first flow path portion is defined by the outer wall and the second inner wall.

34. The apparatus of claim 32 wherein the secondary second flow path portion is defined by the second inner wall and the secondary first flow path portion is defined by the outer wall and the second inner wall.

35. The system of claim 34 wherein the first and second flow paths merge upstream of the diesel oxidation catalyst and are capable of directing flow through the diesel oxidation catalyst.

36. The system of claim 13 wherein the interchange portion is downstream of the gas directing device.

37. A system for treating exhaust gases from an internal combustion engine, the system comprising:

a housing having a first flow path and a second flow path for transporting the exhaust gases from the engine, the flow paths having coaxially arranged portions;

a gas directing device for selectively directing the exhaust gases between the first flow path and the second flow path;

a first NOx adsorbing catalyst contained in the first flow path, the first NOx adsorbing catalyst requiring periodic regeneration to purge accumulated NOx;

a first reductant supply source capable of selectively directing a gas containing a reducing agent to flow into the first NOx adsorbing catalyst;

a second NOx adsorbing catalyst contained in the second flow path, the second NOx adsorbing catalyst requiring periodic regeneration to purge accumulated NOx;

a first catalyzed diesel particulate filter contained in the first flow path upstream of the first NOx adsorbing catalyst wherein the second flow path has a portion that bypasses and is coaxial with the first catalyzed diesel particulate filter and the first NOx adsorbing catalyst; and a second catalyzed diesel particulate filter contained in the second flow path upstream of the second NOx adsorbing catalyst wherein the first flow path has a portion that bypasses and is coaxial with the second catalyzed diesel particulate filter and the second NOx adsorbing catalyst.

38. An apparatus for treating exhaust gases from an internal combustion engine, the apparatus comprising:

a housing having a first flow path and a second flow path for transporting the exhaust gases from the engine, the flow paths having coaxially arranged portions;

a gas directing device for selectively directing the exhaust gases between the first flow path and the second flow path;

a first NOx adsorbing catalyst contained in the first flow path, the first NOx adsorbing catalyst requiring periodic regeneration to purge accumulated NOx;

a second NOx adsorbing catalyst contained in the second flow path, the second NOx adsorbing catalyst requiring periodic regeneration to purge accumulated NOx, wherein the second NOx catalyst is downstream from and in the same general plane as the first NOx adsorbing catalyst;

a first catalyzed diesel particulate filter contained in the first flow path upstream of the first NOx adsorbing catalyst wherein the second flow path has a portion that bypasses and is coaxial with the first catalyzed diesel particulate filter and the first NOx adsorbing catalyst; and a second catalyzed diesel particulate filter contained in the second flow path upstream of the second NOx adsorbing catalyst wherein the first flow path has a portion that bypasses and is coaxial with, and axially outward relative to, the second catalyzed diesel particulate filter and the second NOx adsorbing catalyst.

* * * * *